US009534339B2

(12) United States Patent
Leibman et al.

(10) Patent No.: US 9,534,339 B2
(45) Date of Patent: Jan. 3, 2017

(54) WASHING MACHINE APPLIANCE DISPENSING CUP WITH PUMP

(71) Applicant: General Electric Company, Schenectady, NY (US)

(72) Inventors: Alexander Boris Leibman, Prospect, NY (US); Jerrod Aaron Kapler, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 607 days.

(21) Appl. No.: 13/924,701

(22) Filed: Jun. 24, 2013

(65) Prior Publication Data

US 2014/0373284 A1 Dec. 25, 2014

(51) Int. Cl.
*D06F 39/02* (2006.01)

(52) U.S. Cl.
CPC ..... *D06F 39/022* (2013.01); *D06F 39/028* (2013.01)

(58) Field of Classification Search
CPC ..... D06F 39/02; D06F 39/022; D06F 39/028; A47L 15/4427; B05B 7/2422; B05B 7/2445
See application file for complete search history.

(56) References Cited

U.S. PATENT DOCUMENTS 2,965,268 A 12/1960 Bauerlein
3,132,806 A * 5/1964 McNair ..... B05B 7/2445 215/11.1
2012/0151970 A1* 6/2012 Leibman ..... D06F 39/00 68/17 R

FOREIGN PATENT DOCUMENTS

GB 1168561 A1 10/1969

* cited by examiner

*Primary Examiner* — David Cormier
(74) *Attorney, Agent, or Firm* — Dority & Manning, P.A.

(57) ABSTRACT

A fluid additive dispenser for a washing machine appliance is provided that includes a pump in the form of an aspirator to help remove one or more fluid additives from the dispenser for delivery into the wash chamber. A rinse for the fluid additive dispenser is also provided to help clean the dispenser as well as remove or prevent residue build-up from the fluid additives.

14 Claims, 6 Drawing Sheets

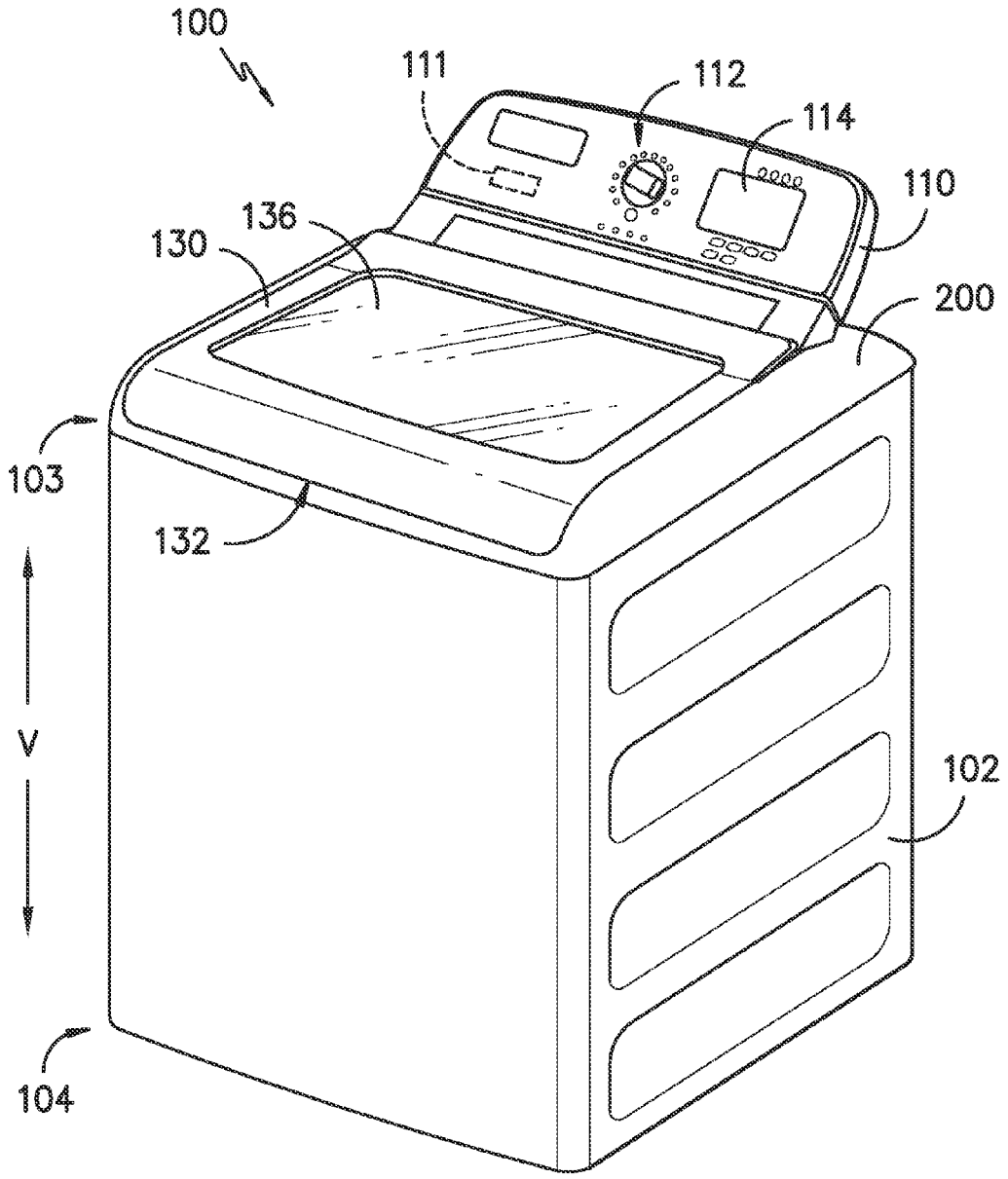
FIG. —1—

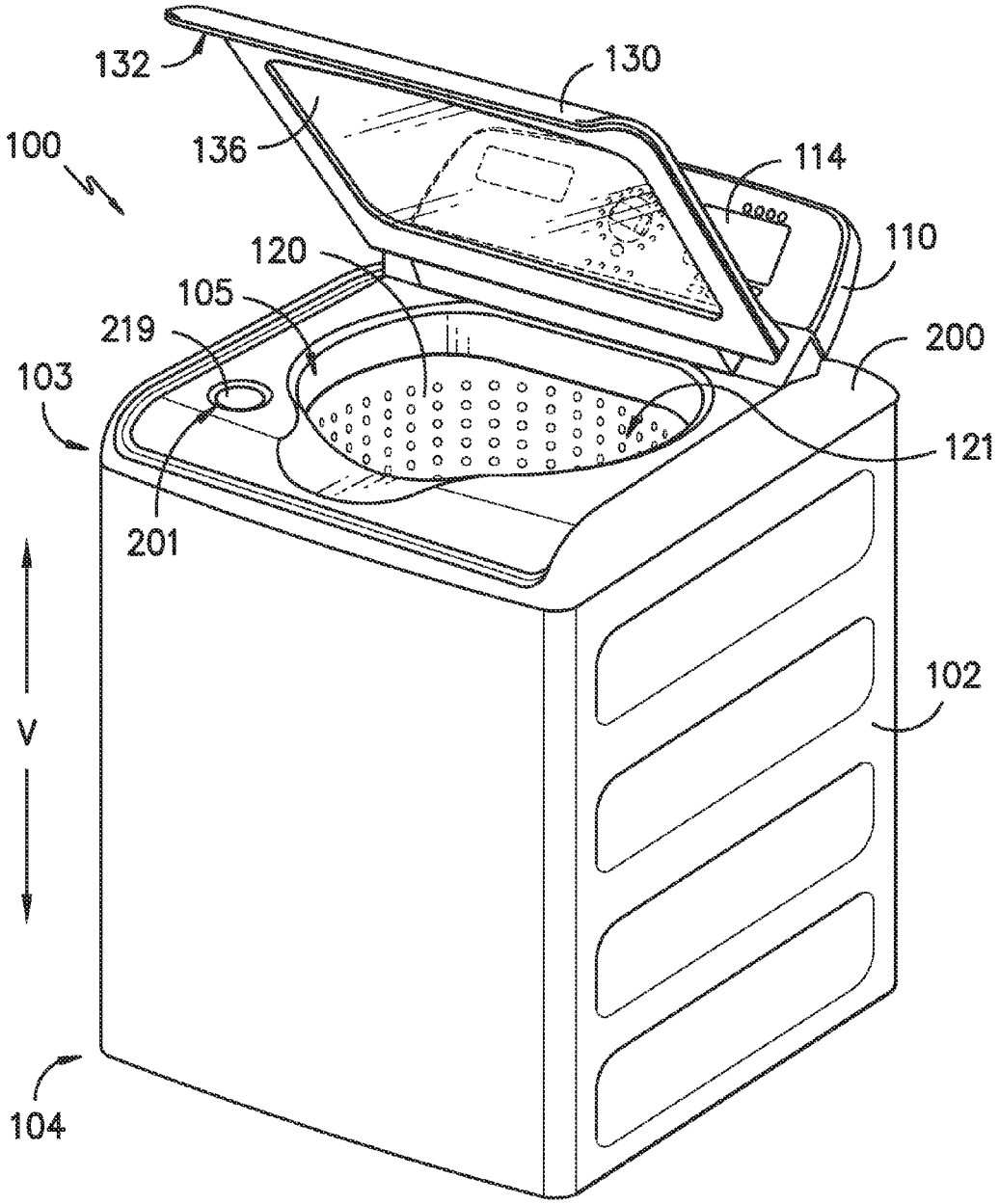
FIG. —2—

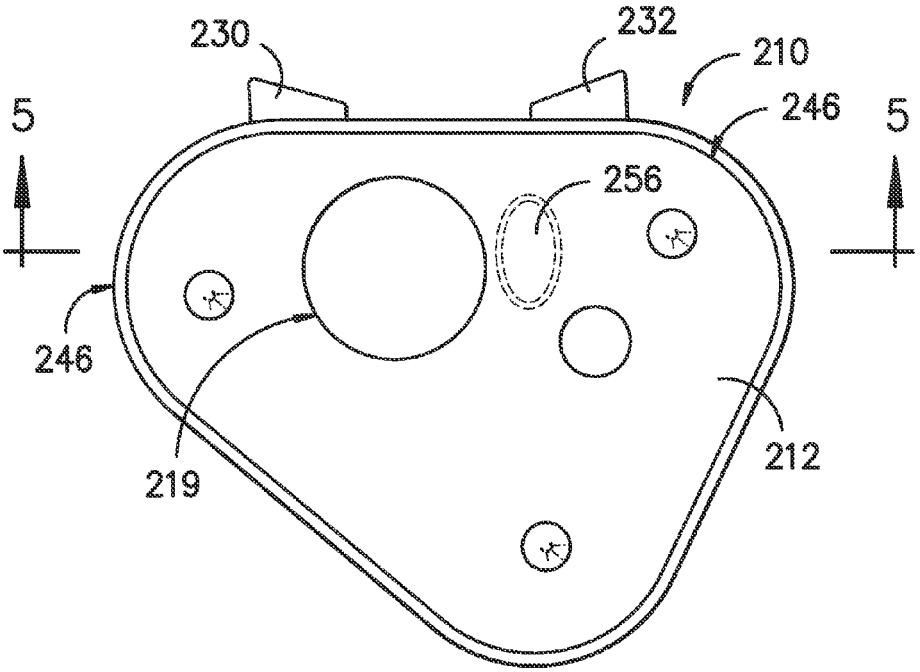
FIG. —3—
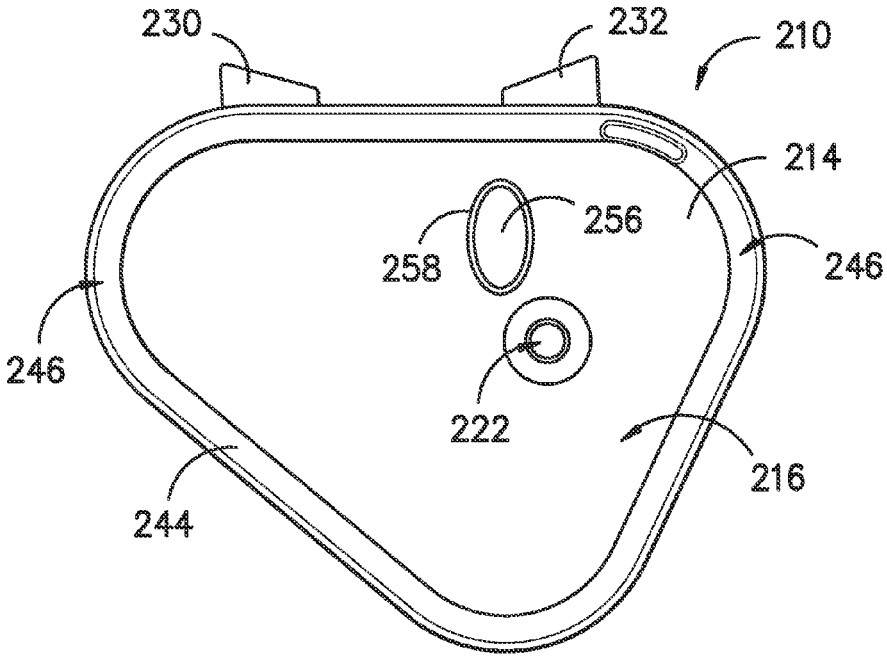
FIG. —4—

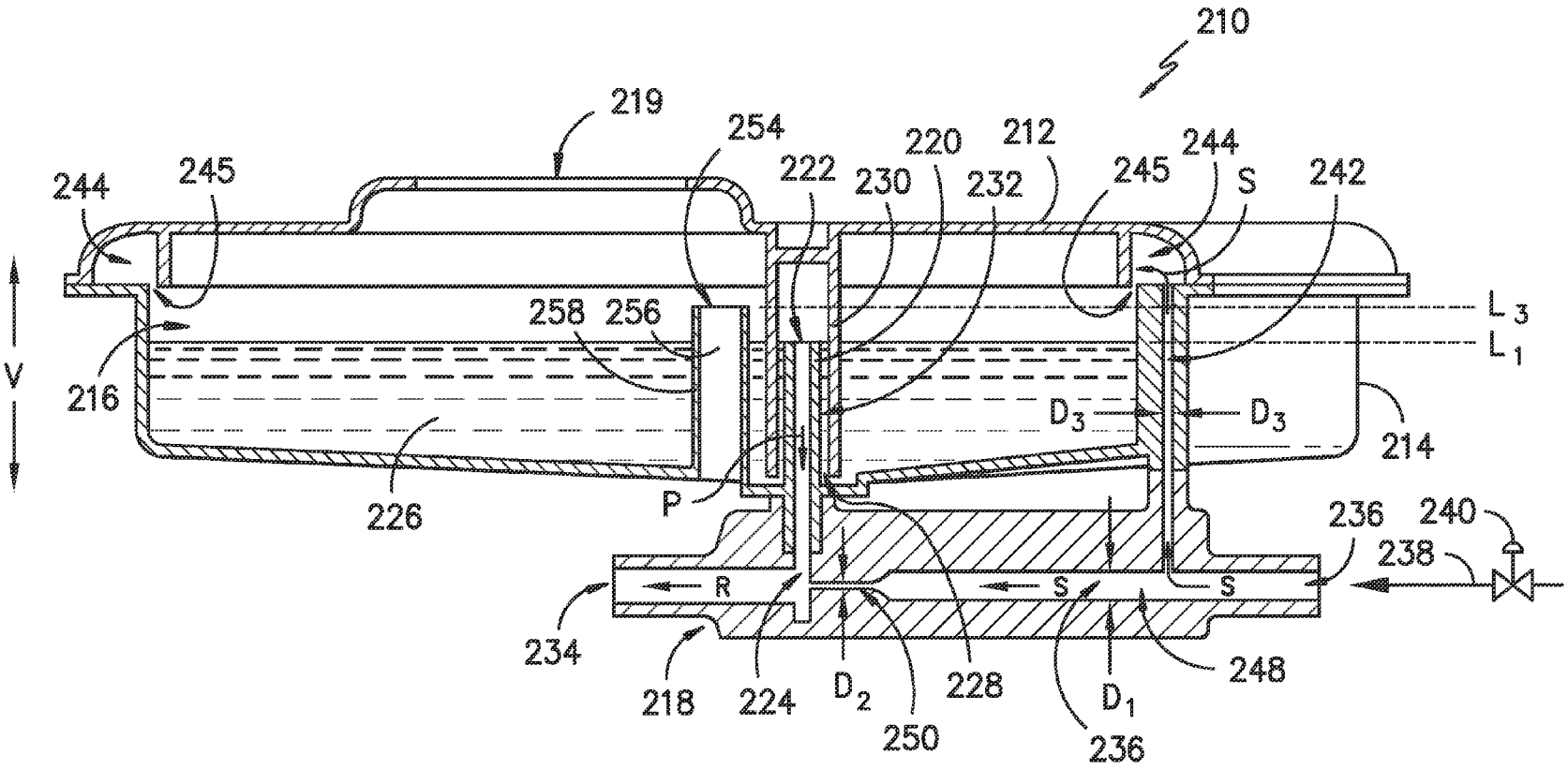
FIG. —6—

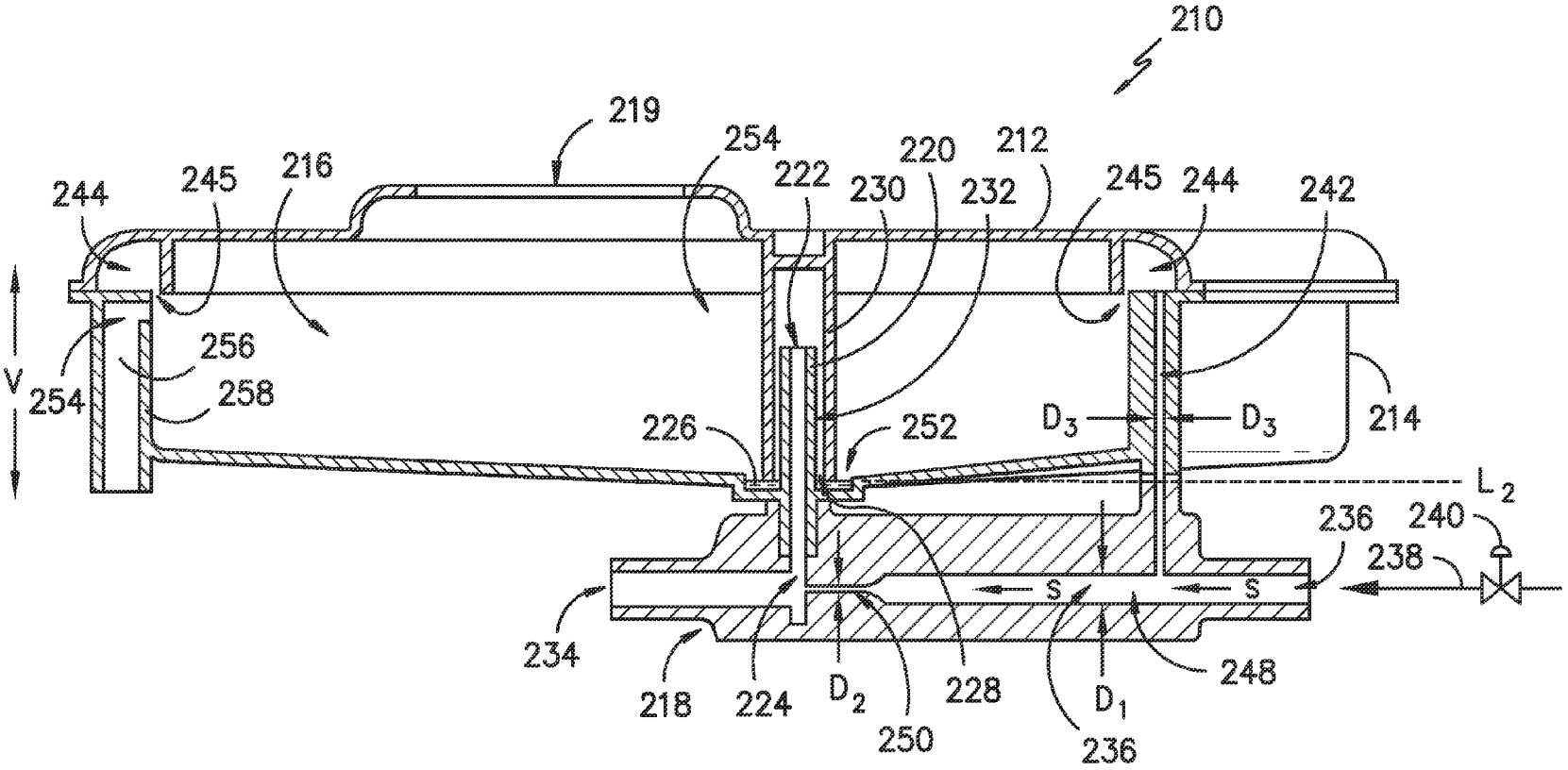
FIG. —7—

WASHING MACHINE APPLIANCE DISPENSING CUP WITH PUMP

FIELD OF THE INVENTION

The subject matter of the present disclosure relates generally to fluid additive dispensers for appliances, e.g., washing machine appliances.

BACKGROUND OF THE INVENTION

Washing machine appliances generally form wash and rinse fluids to clean clothing articles disposed within a wash basket of the appliance. The wash fluid can include, for example, water and various fluid additives, e.g., detergent, fabric softener, and/or bleach. The fluid additives can be mixed with water within a wash tub or wash chamber of the appliance in order to form the wash fluid. Various fluid additives may also be added to water to form the rinse fluid.

To introduce one or more fluid additives into the wash tub, a user can manually add the fluid additive to the wash tub and/or the wash basket. For example, after starting the appliance, the user can pour detergent directly into the wash basket. Certain washing machine appliances may include features for receiving fluid additives and dispensing the fluid additives during operation of the appliance. For example, a tray may be mounted to, or directly beneath, a top panel of a vertical axis washing machine appliance that can receive a fluid additive and direct the fluid additive into a wash tub of the appliance. Similarly, a horizontal axis washing machine appliance can include a drawer with a container mounted therein that receives a fluid additive and directs the fluid additive into a wash tub of the appliance.

With a tray, for example, fluid additive introduced into the tray by the user drains from the tray through a channel or other pathway to the wash chamber or wash bin. However, some fluid additives, such as fabric softener and laundry detergent, can have e.g., a relatively high viscosity, may not drain rapidly from the tray, and/or may a leave behind a residue that is visible to the consumers. The presence of such residual fluid additive in the tray may cause user concerns regarding whether the fluid additive was properly dispensed. In addition, if allowed to remain in the tray, the fluid additive may dry out and leave the residue deposited in the tray. The amount of residue in the tray can increase over time, creating an appearance that is unfavorable to some users and reducing the capacity of the tray. The channel or flow path from the tray may eventually become clogged.

Accordingly, a fluid additive dispenser for a washing machine appliance would be useful. More particularly, a fluid additive dispenser for a washing machine appliance that can more readily deliver fluid additives into the wash chamber would be beneficial. Such a dispenser that can also provide a rinse to help prevent and/or remove e.g., residue would also be useful.

BRIEF DESCRIPTION OF THE INVENTION

The present invention provides a fluid additive dispenser for a washing machine appliance. More particularly, the present invention provides a fluid additive dispenser for a washing machine appliance that includes a pump in the form of an aspirator to help remove one or more fluid additives from the dispenser for delivery into the wash chamber. A rinse for the fluid additive dispenser is also provided to help clean the dispenser as well as remove or prevent residue build-up from the fluid additives. Additional aspects and advantages of the invention will be set forth in part in the following description, or may be apparent from the description, or may be learned through practice of the invention.

In one exemplary embodiment, the present invention provides a washing machine appliance that includes a cabinet with a wash chamber located within the cabinet and configured for containing fluid during operation of the washing machine appliance. A wash basket is rotatably mounted within the wash chamber and is configured for receipt of articles for washing. A fluid additive dispenser is positioned near the wash chamber and is configured for feeding one or more fluid additives into the wash chamber. The fluid additive dispenser includes a reservoir for the receipt of one or more fluid additives, and an aspirator having an aspirator suction inlet positioned at a predetermined level within the reservoir. The aspirator is configured to provide a suction to cause fluid to flow from the reservoir and through the aspirator suction inlet, the aspirator having an aspirator outlet configured to provide fluid from the aspirator to the wash chamber. The aspirator has an aspirator inlet for the receipt of fluid. A supply line is in fluid communication with the aspirator inlet and is configured to provide fluid to the aspirator. A rinse line is in fluid communication with the supply line and the reservoir. The rinse line is configured to deliver fluid into the reservoir as fluid is supplied to the aspirator.

In another exemplary embodiment, the present invention provides a fluid additive dispenser that includes a housing defining a reservoir for the receipt of one or more fluid additives. An aspirator is provided having an aspirator suction inlet positioned within the reservoir. The aspirator is configured to provide a suction to cause fluid to flow from the reservoir and through the aspirator suction inlet. The aspirator has an aspirator outlet configured to provide fluid from the aspirator to the wash chamber. The aspirator has an aspirator inlet for the receipt of fluid. A supply line is in fluid communication with the aspirator inlet and is configured to provide fluid to the aspirator. A rinse line is in fluid communication with the supply line and the reservoir. The rinse line is configured to deliver fluid into the reservoir when fluid is supplied to the aspirator through the supply line.

In another exemplary aspect, the present invention provides a method of operating a washing machine appliance. The washing machine appliance has a wash chamber, a fluid additive dispenser defining a reservoir for the receipt of one or more fluid additives to be delivered to the wash chamber, and an aspirator for drawing fluid from the reservoir. The method includes the steps of flowing water through the aspirator for a first period time so as to cause fluid additive to flow from the reservoir, through the aspirator, and to the wash chamber; directing a flow of water into the reservoir during the first period of time; ending the step of flowing water through the aspirator for the first period of time; allowing fluid to drain through the aspirator during a second period of time; flowing water through the aspirator for a third period of time; and providing a flow of water into the reservoir during the third period of time so as rinse the reservoir.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 1 illustrates an exemplary embodiment of a washing machine appliance of the present invention with a door shown in the closed position.

FIG. 2 illustrates the exemplary embodiment of a washing machine shown in FIG. 1 except with a door shown in an open position.

FIG. 3 is a top view of an exemplary embodiment of a fluid dispenser of the present invention with an upper portion or cover shown in place.

FIG. 4 is a top view of the exemplary embodiment of the fluid dispenser of FIG. 3 with an upper portion or cover removed to more clearly reveal details of the lower portion.

FIGS. 5, 6, and 7 are cross-sectional views of the exemplary embodiment of FIG. 3 as will be more fully described.

DETAILED DESCRIPTION OF THE INVENTION

Figure 5:
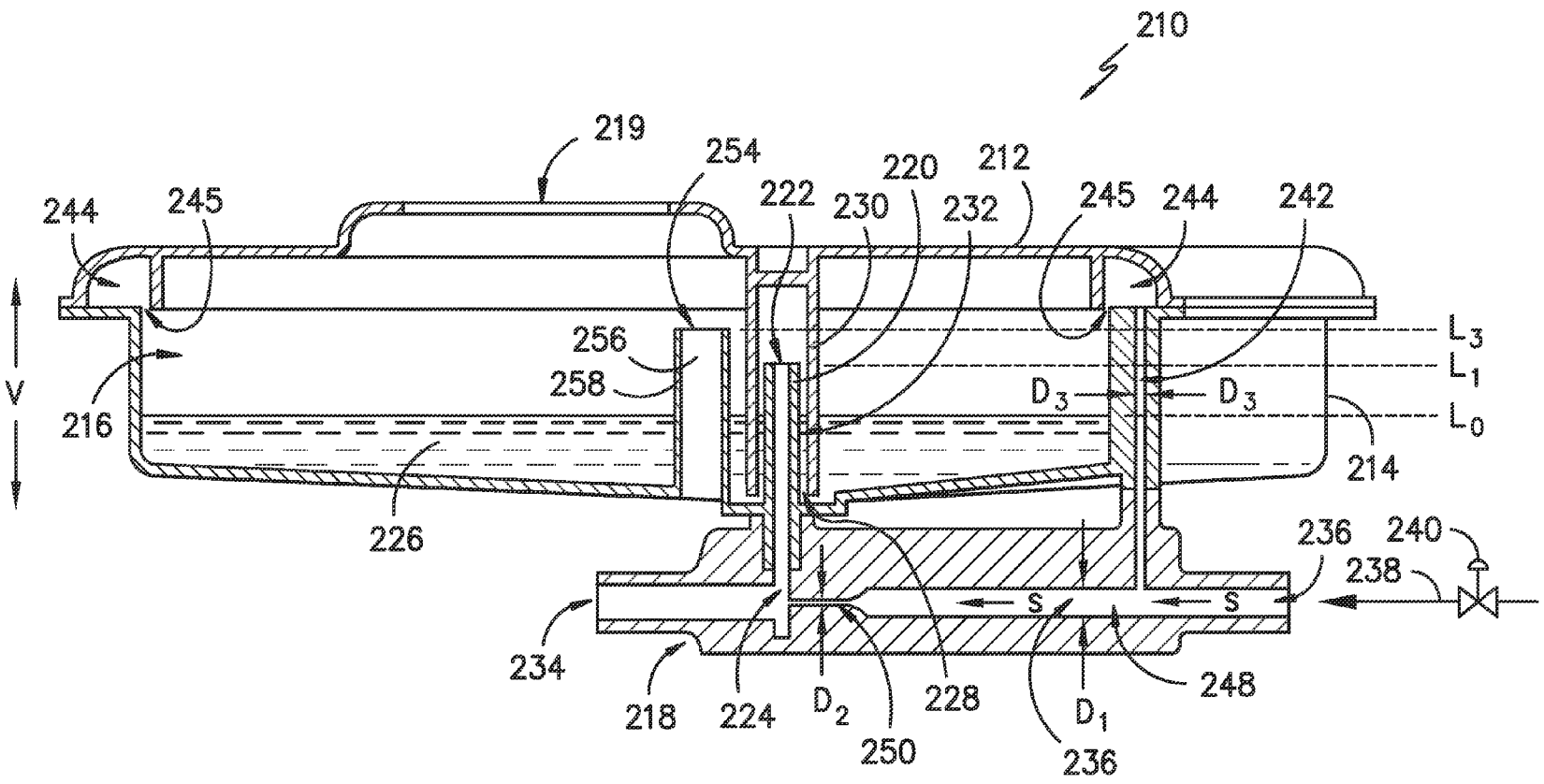

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIGS. 1 and 2 illustrate an exemplary embodiment of a vertical axis washing machine appliance 100. In FIG. 1, a lid or door 130 is shown in a closed position. In FIG. 2, door 130 is shown in an open position. While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, and/or different features may also be utilized with the present subject matter as well, e.g., horizontal axis washing machines.

Washing machine appliance 100 has a cabinet 102 that extends between a top 103 and a bottom 104 along a vertical direction V. A wash basket 120 (FIG. 2) is rotatably mounted within cabinet 102. A motor (not shown) is in mechanical communication with wash basket 120 in order to selectively rotate wash basket 120 (e.g., during an agitation or a rinse cycle of washing machine appliance 100). Wash basket 120 is received within a wash bin or wash chamber 121 (FIG. 2) and is configured for receipt of articles for washing. The wash chamber 121 holds wash and rinse fluids for agitation in wash basket 120 within wash chamber 121. An agitator or impeller (not shown) extends into wash basket 120 and is also in mechanical communication with the motor. An impeller (now shown) can assist agitation of articles disposed within wash chamber 121 during operation of washing machine appliance 100.

Cabinet 102 of washing machine appliance 100 has a top panel 200. Top panel 200 defines an opening 105 (FIG. 2) that permits user access to wash chamber 121 of wash basket 120. Door 130 is rotatably mounted to top panel 200. However, alternatively, door 130 may be mounted to cabinet 102 or any outer suitable support. Door 130 selectively rotates between the closed position shown in FIG. 1 and the open position shown in FIG. 2. In the closed position, door 130 inhibits access to wash chamber 121. Conversely, in the open position, a user can access wash chamber 121. A window 136 in door 130 permits viewing of wash chamber 121 when door 130 is in the closed position, e.g., during operation of washing machine appliance 100. Door 130 also includes a handle 132 that, e.g., a user may pull and/or lift when opening and closing door 130.

Top panel 200 defines at least one opening 201 (FIG. 2) for receipt of one or more fluid additives, e.g., detergent, fabric softener, and/or bleach. While only one opening and fluid dispenser will be described herein, it will be understood the multiple openings and fluid dispensers may be used in alternative embodiments of the invention. Opening 201 permits fluid additives to pass through top panel 200 and through an opening 219 in a fluid additive dispenser 210 (FIG. 3) disposed below top panel 200 (along the vertical direction V) and positioned near wash chamber 121. Fluid additive dispenser 210 is described in greater detail below.

A control panel 110 with at least one input selector 112 (FIG. 1) extends from top panel 200. Control panel 110 and input selector 112 collectively forms a user interface input for operator selection of machine cycles and features. A display 114 of control panel 110 indicates selected features, operation mode, a countdown timer, and/or other items of interest to appliance users regarding operation.

Operation of washing machine appliance 100 is controlled by a controller 111 or processing device (shown schematically in FIG. 1) that is operatively coupled to control panel 110 and input selector 112 for user manipulation to select washing machine cycles and features. In response to user manipulation of control panel 110, the controller 111 operates the various components of washing machine appliance 100 to execute selected machine cycles and features.

In an illustrative embodiment, laundry items are loaded into wash chamber 121 through opening 105, and washing operation is initiated through operator manipulation of input selectors 112. A tub or wash basket 120 (shown in FIG. 3) is filled with water and detergent and/or other fluid additives from e.g., fluid additive dispenser 210, to form wash and rinse fluids. One or more valves (not shown) can be controlled by washing machine appliance 100 to provide for filling wash basket 120 to the appropriate level for the amount of articles being washed and/or rinsed. By way of example for a wash mode, once wash basket 120 is properly filled with fluid, the contents of wash chamber 121 can be agitated (e.g., with an impeller as discussed previously) for washing of laundry items in wash basket 120.

After the agitation phase of the wash cycle is completed, wash basket 120 can be drained. Laundry articles can then be rinsed by again adding e.g., water, fabric softener, and other fluids to wash basket 120 depending on the particulars of the cleaning cycle selected by a user. The impeller may again provide agitation within wash chamber 121. One or more spin cycles may also be used. In particular, a spin cycle may be applied after the wash cycle and/or after the rinse cycle in order to wring wash fluid from the articles being washed. During a spin cycle, wash basket 120 is rotated at relatively high speeds. After articles disposed in wash basket 120 are cleaned and/or washed, the user can remove the articles from wash basket 120, e.g., by reaching into wash chamber 121 through opening 105.

FIG. 3 is a top view of an exemplary embodiment of a fluid additive dispenser 210. An upper portion 212 of dispenser 210 is shown in place in FIG. 3. FIG. 4 is also a top view but with upper portion 212 of dispenser 210 removed to show lower portion 214. By way of example, portions 212 and 214 can be plastic molded parts that are joined to create dispenser 210 having a dispenser reservoir 216 (FIG. 5) for the receipt of one or more fluid additives. An opening 219 is formed in upper portion 212 whereby one more fluid additives may be introduced into dispenser reservoir 216. Other constructions may be used as well to create dispenser 210. FIGS. 5, 6 and 7 provide cross-sectional views of fluid additive dispenser 210 as will be further described below.

Dispenser 210 includes a pump in the form of an aspirator 218. As shown, aspirator 218 has an aspirator inlet leg 220 that positions an aspirator suction inlet 222 at a predetermined level $L_1$ within reservoir 216. Aspirator 218 has an aspirator injection port 224 that is positioned along aspirator inlet leg 220 at a vertical level that is lower, or below, aspirator suction inlet 222.

For this exemplary embodiment, a fluid additive 226 (such as e.g., a wash additive, rinse additive, or combinations thereof) can be delivered into reservoir 216 and it is filled to a vertical level above level $L_1$. Such fluid 226 can flow into an annulus 228 formed between a conduit 230 extending downwardly from upper portion 212 and an outside surface 232 of aspirator inlet leg 220. From here, fluid 226 will flow into aspirator suction inlet 222. Eventually, as the fluid reaches level $L_1$ a siphoning action can cause fluid 226 to be drawn through annulus 228 and aspirator inlet leg 220 for delivery to wash chamber 121 through an aspirator outlet 234. However, depending upon e.g., the viscosity of such fluid, the flow rate through aspirator 218 may be limited or too slow. Accordingly, the present invention uses aspirator 218 as a pump to help facilitate the flow of fluid from dispenser 210 as will be further described.

Aspirator 218 has an aspirator inlet 236. A supply line 238 is in fluid communication with the aspirator inlet 236 and is configured to provide a fluid such as e.g., water to aspirator 218. Supply line 238 may e.g., a hose or tubing connected with a water supply. Water flow through supply line 238 can be controlled by valve 240—such as e.g., a solenoid valve—that is connected with, and operated by, controller 111.

A rinse line 242 is in fluid communication with supply line 238 and reservoir 216. More particularly, for this exemplary embodiment, rinse line 242 is shown connected to aspirator inlet 236. However, in other embodiments, rinse line 242 maybe connected directly into supply line 238 downstream of valve 240. In either case, rinse line 242 feeds a fluid such as water into reservoir 216 through a distribution channel 244 that extends around the peripheral edge 246 (FIGS. 3 and 4) of dispenser 210. A small gap or opening 245 allows fluid to exit channel 244 and enter reservoir 216. Because channel 244 and opening 245 extend around reservoir 216, water flowing into reservoir 216 from channel 244 can be used to rinse fluid additives 226 from reservoir 216 as will be further described.

An exemplary method of using fluid dispenser 210 will now be provided. It will be understood that controller 211 can be configured to operate appliance 100 according to this exemplary method. One of skill in the art, using the teachings disclosed herein, will understand that other exemplary methods falling within the scope of the present invention may be used as well.

In one exemplary method, a user places one or more fluid additives 226 (such as e.g., detergent, bleach, and fabric softener) into fluid dispenser 210 to an initial level $L_o$ as shown in FIG. 5. The user initiates operation of appliance 100 using e.g., selector 112. During the resulting cleaning process, in order to move fluid additive 226 from dispenser 210 to wash chamber 121, controller 211 causes valve 240 to open for a first period of time $\Delta t_1$. The opening of valve 240 causes a fluid such as e.g., water to flow through aspirator inlet 236 as shown by arrows S during the first period of time $\Delta t_1$.

Aspirator inlet 236 is divided into two portions: a first aspirator channel 248 and a second aspirator channel 250. As shown, second aspirator channel 250 is downstream from first aspirator channel 248 and has a second aspirator channel diameter $D_2$ that is less the first aspirator channel $D_1$. Accordingly, as the flow of fluid passes through aspirator inlet 236, the velocity must increase as it moves from first aspirator channel 248 into second aspirator channel 250. This velocity increase is associated with a pressure reduction. In turn, the pressure reduction creates a vacuum or suction in aspirator inlet leg 220. In one exemplary embodiment of the present invention, the second aspirator channel has a diameter $D_2$ in the range of about 0.1 inches to about 0.150 inches while the first aspirator channel has a diameter $D_1$ in the range of about 0.2 inches to about 0.3 inches. In still another exemplary embodiment, the second aspirator channel has a flow diameter $D_2$ of about 0.125 inches while the first aspirator channel has a flow diameter $D_1$ of about 0.25 inches.

As fluid is flowing through aspirator inlet 236, fluid from supply line 238 also travels into and through rinse line 242. In exemplary embodiment, rinse line 242 has a flow path diameter $D_3$ in the range of about 0.07 inches to about 0.11 inches. In still another embodiment, rinse line 242 has a flow diameter $D_3$ of about 0.09 inches. Fluid is then delivered into channel 244 around the periphery 246 of dispenser 210 and into reservoir 216. Such fluid then combines with fluid additive 226 to raise the fluid level in reservoir 216 to level $L_1$ as shown in FIG. 6. As the fluid level reaches or exceeds level $L_1$, the suction created by aspirator 218 draws fluid into aspirator inlet leg 220 through aspirator suction inlet 222. This fluid (which is a combination of the original fluid additive 226 and a fluid such as water from supply line 238) then travels through aspirator inlet leg 220 as shown by arrows P and is delivered through aspirator injection port 224 into the high velocity jet of fluid provided exiting from second aspirator channel 250 to provide a combined flow R that is delivered to wash chamber 121 through aspirator outlet 234.

As such, aspirator 218 provides a suction that helps expedite the delivery of fluid additive from dispenser 210. In addition, the addition of a fluid such as water into reservoir 216 using rinse line 242 can help lower the viscosity of the original fluid additive 226, which can further improve its flow rate and thereby decrease delivery time of the fluid additive. In one exemplary aspect of the present invention, first time period $\Delta t_1$ can be selected as a time period sufficient to raise the level of fluid additive 226 to level $L_1$ and start flow through the aspirator inlet leg 220. For example, first time period $\Delta t_1$ may be in the range of about 65 second to about 85 seconds. In still another embodiment, first time period $\Delta t_1$ may be about 75 seconds.

After the first time period $\Delta t_1$, valve 240 is closed for second time period $\Delta t_2$ during which fluid will continue to drain from reservoir 216 (under the siphoning action previously described) and flow through aspirator outlet 234 to wash chamber 121. The rate of flow during this siphoning action can be also be improved by the dilution of fluid additive 226 with e.g., water from supply line 238 that reduces the viscosity of fluid additive 226. Eventually, most of the fluid will drain from reservoir 216 until the level falls to level $L_2$ at the distal end 252 of conduit 230 as shown in FIG. 7. Second time period $\Delta t_2$ can be selected as a time period sufficient to allow fluid to drain substantially completely from reservoir 216. For example, in one embodiment, second time period $\Delta t_2$ may be in the range of about 60 seconds to about 80 seconds. In still another embodiment, first time period $\Delta t_1$ may be about 70 seconds.

After the second period of time, valve 240 is opened again for a third period of time $\Delta t_3$. During third period of time $\Delta t_3$, fluid travels through aspirator 218 again causing suction through aspirator inlet leg 220. Fluid from rinse line 242 will again travel into reservoir 216 through channel 244. This fluid provides a rinse or reservoir 216 to help remove residue of fluid additive 226 that might be left over from the first period of time $\Delta t_1$ and the second period of time $\Delta t_2$. The rinsing fluid rises in reservoir 216 until it reaches level $L_1$, at which the fluid will again be suctioned out of reservoir 216 by the operation of aspirator 218. Third period of time $\Delta t_3$ may be determined as the time sufficient to allow for rinsing of any residue from reservoir 216. For example, third time period $\Delta t_3$ may be in the range of about 65 second to about 85 seconds. In still another embodiment, third time period $\Delta t_3$ may be about 75 seconds.

As shown in FIGS. 5 and 6, an overflow channel 256 is provided by a conduit 258 that extends upwardly from lower portion 214 into reservoir 216. In the event fluid in reservoir 216 rises to level $L_3$, fluid can flow into conduit 258 through overflow channel receiving end 254 and be released into e.g., wash chamber 121. FIG. 7 provides an alternative embodiment where overflow channel 256 is positioned outside of reservoir 216.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance, comprising:

a cabinet, including a top panel defining a first opening for receipt of articles for washing and a second opening for receipt of one or more fluid additives;

a wash chamber located within the cabinet and beneath the top panel, the wash chamber being configured for containing fluid during operation of the washing machine appliance;

a wash basket rotatably mounted within the wash chamber and beneath the top panel for receipt of articles for washing through the first opening;

a fluid additive dispenser positioned near the wash chamber and configured for feeding one or more fluid additives into the wash chamber, the fluid additive dispenser comprising an upper portion disposed below the top panel, the upper portion defining an opening for receipt of one or more fluid additives passing through the second opening of the top panel, a lower portion joined with the upper portion and defining a reservoir for the receipt of one or more fluid additives from the opening of the upper portion, an aspirator having an aspirator inlet leg extending vertically through the lower portion, the aspirator inlet leg defining an aspirator suction inlet positioned at a predetermined level within the reservoir below the upper portion, the aspirator configured to provide a suction to cause fluid to flow from the reservoir through the aspirator suction inlet, the aspirator having an aspirator outlet configured to provide fluid from the aspirator to the wash chamber, the aspirator having an aspirator inlet for the receipt of fluid, a supply line in fluid communication with the aspirator inlet and configured to provide fluid to the aspirator, and a rinse line in fluid communication with the supply line and the reservoir, the rinse line configured to deliver fluid into the reservoir as fluid is supplied to the aspirator;

wherein the upper portion includes a conduit extending downwardly over the aspirator inlet leg to a position below the aspirator suction inlet, and wherein the rinse line extends vertically through the lower portion above the aspirator suction inlet.

2. The washing machine appliance of claim 1, wherein the aspirator inlet comprises:

a first aspirator channel disposed below the lower portion, the first aspirator channel being connected with the supply line and having a first aspirator channel diameter; and a second aspirator channel disposed below the lower portion and positioned downstream of the first aspirator channel, the second aspirator channel having a second aspirator channel diameter that is less than the first aspirator channel diameter.

3. The washing machine appliance of claim 2, wherein the second aspirator channel has a diameter in the range of about 0.1 inches to about 0.150 inches.

4. The washing machine appliance of claim 3, wherein the first aspirator channel has a diameter in the range of about 0.2 inches to about 0.3 inches.

5. The washing machine appliance of claim 4, wherein the rinse line has a rinse line diameter in the range of about 0.07 inches to about 0.11 inches.

6. The washing machine appliance of claim 2, further comprising:

a valve connected to the supply line and configured for controlling the flow of fluid through the supply line;

a controller operably connected with the valve, the controller configured for opening the valve for a first period of time to provide fluid flow through the aspirator and the rinse line so that a level of fluid in the reservoir is at or above the aspirator suction inlet;

closing the valve for a second period of time while fluid passes from the reservoir to the aspirator; and opening the valve for a third period of time to provide fluid flow through the aspirator and the rinse line so that a level of fluid in the reservoir is at or above the aspirator suction inlet.

7. The washing machine appliance as in claim 1, further comprising an overflow channel extending into the reservoir, the overflow channel having an overflow channel receiving end at a height greater than the aspirator suction inlet.

8. The washing machine appliance as in claim 1, wherein the fluid additive dispenser further comprises a distribution channel defined by the upper portion and extending around the reservoir, the distribution channel in fluid communication with the rinse line and configured to distribute fluid from the rinse line into the reservoir.

9. A fluid additive dispenser for an appliance, the fluid additive dispenser comprising:

a housing that includes an upper portion defining an opening for receipt of one or more fluid additives, and a lower portion joined with the upper portion and defining a reservoir for the receipt of one or more fluid additives from the opening of the upper portion;

an aspirator having an aspirator inlet leg extending vertically through the lower portion, the aspirator inlet leg defining an aspirator suction inlet positioned within the reservoir below the upper portion, the aspirator configured to provide a suction to cause fluid to flow from the reservoir and through the aspirator suction inlet, the aspirator having an aspirator outlet configured to provide fluid from the aspirator to a wash chamber of the appliance, the aspirator having an aspirator inlet for the receipt of fluid;

a supply line in fluid communication with the aspirator inlet and configured to provide fluid to the aspirator; and a rinse line in fluid communication with the supply line and the reservoir, the rinse line configured to deliver fluid into the reservoir when fluid is supplied to the aspirator through the supply line;

wherein the upper portion includes a conduit extending downwardly over the aspirator inlet leg to a position below the aspirator suction inlet, and wherein the rinse line extends vertically through the lower portion above the aspirator suction inlet.

10. The fluid additive dispenser as in claim 9, wherein the aspirator inlet comprises:

a first aspirator channel disposed below the lower portion, the first aspirator channel being connected with the supply line and having a first aspirator channel diameter for the flow of fluid; and a second aspirator channel disposed below the lower portion and positioned downstream of the first aspirator channel, the second aspirator channel having a second aspirator channel diameter for the flow of fluid that is less than the first aspirator channel diameter.

11. The fluid additive dispenser as in claim 10, wherein the second aspirator channel has a diameter in the range of about 0.1 inches to about 0.150 inches.

12. The fluid additive dispenser as in claim 11, wherein the first aspirator channel has a diameter in the range of about 0.2 inches to about 0.3 inches.

13. The fluid additive dispenser as in claim 11, wherein the rinse line has a rinse line diameter in the range of about 0.07 inches to about 0.11 inches.

14. The fluid additive dispenser as in claim 9, further comprising an overflow channel extending into the reservoir, the overflow channel having an overflow channel receiving end at a height above the aspirator suction inlet.

* * * * *